US005758563A

United States Patent [19]

Robinson

[11] Patent Number: 5,758,563

[45] Date of Patent: Jun. 2, 1998

[54] FLUID DRIVEN RECIPROCATING PUMP

[75] Inventor: Ronald Lee Robinson, Windham, Ohio

[73] Assignee: Holcom Co., Mentor, Ohio

[21] Appl. No.: 735,643

[22] Filed: Oct. 23, 1996

[51] Int. Cl.[6] ..... F01L 31/02; F04B 17/00

[52] U.S. Cl. ..... 91/346; 91/329; 91/350; 417/393; 417/395

[58] Field of Search ..... 417/393, 395; 92/48, 49, 63, 96; 91/327, 328, 329, 344, 346, 347, 348, 350, 353

[56] References Cited

U.S. PATENT DOCUMENTS

| | | | |
|---|---|---|---|
| 2,792,785 | 5/1957 | Hayden . | |
| 2,798,440 | 7/1957 | Hall . | |
| 2,977,040 | 3/1961 | Dulebohn et al. | 91/346 X |
| 3,782,863 | 1/1974 | Rupp . | |
| 4,008,984 | 2/1977 | Scholle | 417/395 X |
| 4,172,698 | 10/1979 | Hinz et al. . | |
| 4,540,349 | 9/1985 | Du . | |
| 4,682,937 | 7/1987 | Credle, Jr. . | |
| 4,705,458 | 11/1987 | Laurent et al. | 91/346 X |
| 4,854,832 | 8/1989 | Gardner et al. | 417/395 X |
| 4,923,168 | 5/1990 | Murata et al. . | |
| 5,002,469 | 3/1991 | Murata et al. . | |
| 5,391,060 | 2/1995 | Kozumplik, Jr. et al. . | |
| 5,545,016 | 8/1996 | Wang . | |
| 5,564,911 | 10/1996 | Santa | 417/395 |

*Primary Examiner*—Hoang Nguyen
*Attorney, Agent, or Firm*—Renner, Otto, Boisselle & Sklar, P.L.L.

[57] ABSTRACT

A fluid-driven reciprocating pump includes a housing and a reciprocating assembly defining first and second working fluid chambers. The housing includes an inlet and an outlet for introduction and exhaustion of the working fluid. A valve member slidably moves against a valve surface between a first position, in which communication is established between the first working fluid chamber and either the power fluid inlet or outlet, and a second position in which communication is established between the second working fluid chamber and the same inlet or outlet. The reciprocating assembly includes a rod which moves in response to the introduction and exhaustion of the power fluid into and out of the first and second working chambers. A control valve actuator shifts the valve member between the first and second positions in response to the movement of the reciprocating rod and also urges the valve member toward the valve surface to form a fluid-tight union therebetween.

11 Claims, 5 Drawing Sheets

FLUID DRIVEN RECIPROCATING PUMP

FIELD OF THE INVENTION

This invention relates generally to a fluid driven reciprocating pump. More particularly, the invention relates to a fluid driven reciprocating pump including a control valve actuator which switches a valve member between first and second positions in response to the movement of a reciprocating rod and which urges the valve member toward a valve surface to form a fluid-tight seal therebetween.

BACKGROUND OF THE INVENTION

Fluid driven reciprocating pumps are widely used for pumping liquids. Typically, such a pump includes a housing and a reciprocating assembly which together define various chambers of the pump. For example, these components define first and second pump chambers for the pumped fluid and first and second power chambers for the working fluid. The housing usually also defines inlet and outlet passages for the pumped fluid (i.e., the fluid being pumped) and inlet and outlet passages for the working fluid (i.e., the fluid driving the pump).

The reciprocating assembly of a fluid driven reciprocating pump typically includes first and second piston members coupled to the opposite ends of a rod. The first piston member separates the first pump chamber from the first power chamber; and the second piston member separates the second pump chamber from the second power chamber. The alternate connection of the power chambers to working fluid under pressure and exhaust causes the volumes of the first and second pump chambers and the rod connected between the piston members to reciprocate.

One type of fluid driven reciprocating pump is an air actuated double diaphragm pump. In such a pump, air is the working fluid and the piston members of the reciprocating assembly include flexible diaphragms for minimizing and maximizing the volume of the pump chambers. Air actuated double diaphragm pumps are commonly used in the food industry and other hygiene conscious industries due to their ability to be easily cleaned and their complete separation of the pumped fluid from possible contamination by the working fluid. Also, air actuated diaphragm pumps are often used in situations where a metered output flow is required or where flammable liquids are being pumped and explosions could occur if fumes were ignited by an electric spark.

A typical pump's housing defines a valve surface and a typical pump's reciprocating assembly includes a valve member to control the introduction and exhaustion of the power fluid to and from the power chambers. In such an arrangement, the valve member will slidably move against the valve surface between a first position and a second position in response to movement of the reciprocating rod. In the first position, communication is established between the first power chamber and the working fluid while the second power chamber is connected to exhaust. In the second position, the connections are reversed so that the first power chamber is connected to the exhaust while the second power chamber is supplied with working fluid under pressure.

Various sealing techniques are used to maintain a fluid-tight seal between the valve surface and the valve member. Among them are constructing a valve from concentric tubes with various lands and orifices. These valves are sealed with O-rings which surround the inner tube. Other valves are made with valve members which slide across a flat surface, and the member and surface have orifices and passages that come into alignment, depending on the position of the valve member. These valve members have been sealed by a spring that pushes the member against the surface and have been shifted between the various positions by a separate element that moves the valve member to the desired position.

Once the reciprocating rod reaches a certain point in its stroke, the valve member must switch to the opposite position to reverse the flow direction of the working fluid relative to the power chambers. Accordingly, a typical pump includes a switch element to move the valve member between its two positions. In the past, it has been common for the switch elements to include a biasing element, such as a spring arranged to toggle the valve mechanism back and forth. Another mechanism used is a lost motion connection between the reciprocating rod and the valve mechanism.

SUMMARY OF THE INVENTION

The present invention provides a simplified design for a fluid driven reciprocating pump in which a control valve actuator performs both switching and sealing functions. More particularly, the present invention provides a control valve actuator which switches a valve member between first and second positions in response to the movement of a reciprocating rod. At the same time, the control valve actuator also urges the valve member toward a valve surface to provide a fluid-tight seal therebetween. The preferred pump is a double diaphragm pump in which the reciprocating assembly has first and second piston members each in the form of flexible diaphragms.

The preferred control valve actuator is coupled to the reciprocating rod and the valve member, and more preferably, the control valve actuator is coupled only to these members and is free of any other connections. The control valve actuator can be in the form of a spring which reaches a maximum compression when the rod member is between its first and second positions, and remains in compression as the valve member moves between these positions. The preferred spring is arranged so that it applies a force constantly biasing the valve member against the valve surface and also a force urging the valve member away from the central position and toward one or the other of the first and second positions depending on the position of the rod. As a result, the spring produces a force applied to the valve member that has a non-zero component parallel with a line between the first and second positions of the valve member and another non-zero component normal to the valve surface.

These and other features of the invention are fully described and particularly pointed out in the claims. The following annexed drawings set forth in detail a certain illustrative embodiment, this embodiment being indicative of but one of the various ways in which the principles of this invention may be practiced.

BRIEF DESCRIPTION OF THE DRAWINGS

In the annexed drawings, a fluid driven double diaphragm pump according to the present invention, and components thereof, are shown. The pump is generally cylindrical in shape and is positioned (for the purposes of the drawings) so that its longitudinal axis is horizontal. As is explained in more detail below, the pump includes a housing and a reciprocating assembly which moves between a first position and a second position.

Specifically, in the annexed drawings.

DETAILED DESCRIPTION OF A PREFERRED EMBODIMENT

Figure 1:
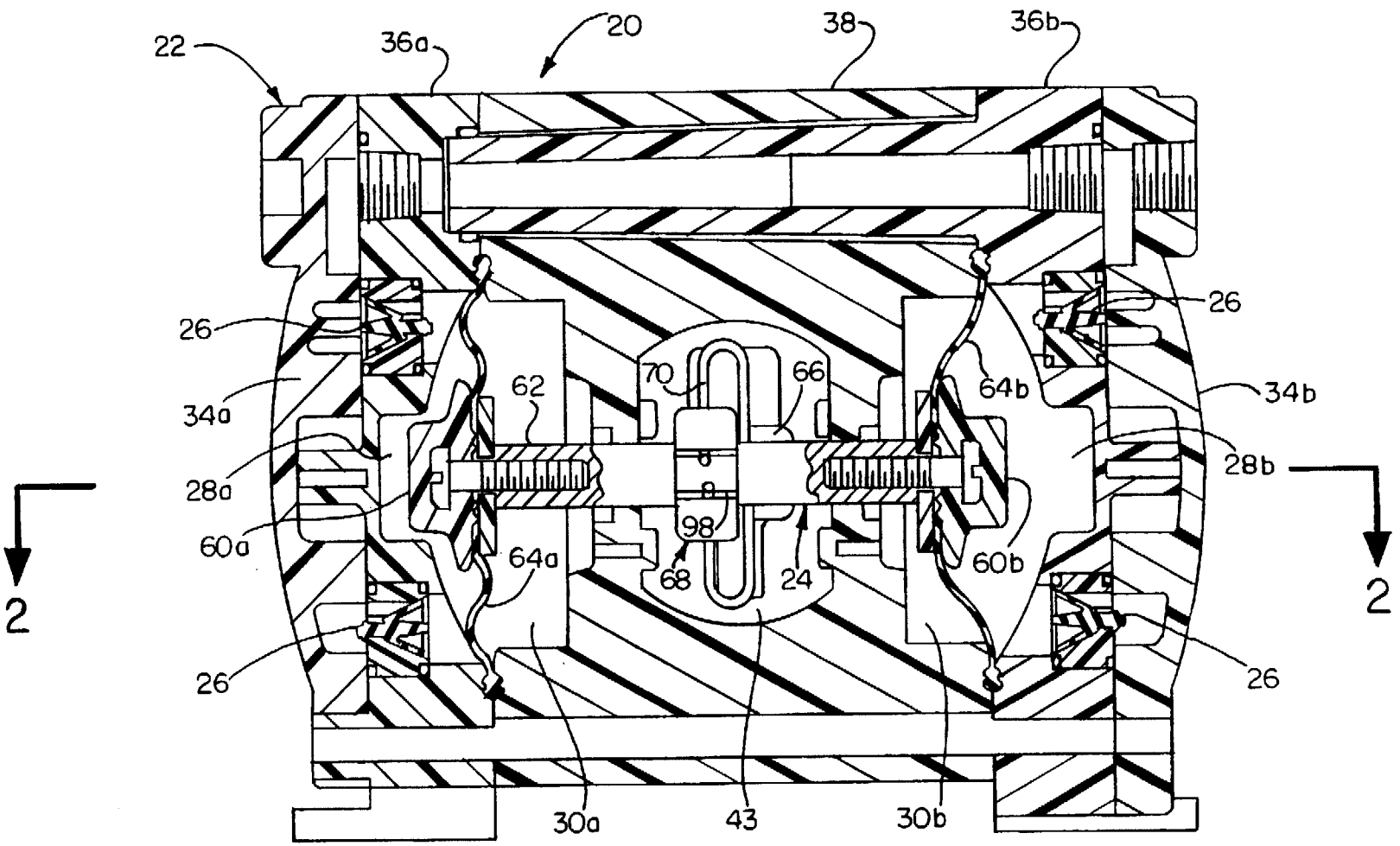
FIG. 1 is a cross-sectional view of a pump constructed in accordance with the present invention with its reciprocating assembly in the first position, the section being taken along a vertical plane which passes through the pump's longitudinal axis, except that the certain portions of the reciprocating assembly (namely, the central portion of a rod member and a control valve actuator ) are in elevation view.

FIG. 1 shows a fluid driven reciprocating pump 20 according to the present invention. The pump 20 comprises a housing 22 and a reciprocating assembly 24. The preferred pump 20 is an air actuated double diaphragm pump in which pressurized air is the working fluid and the reciprocating assembly 24 includes flexible diaphragms.

The components forming the pump's housing 22 and its reciprocating assembly 24 together define various chambers of the pump 20. Specifically, these components define a first pump chamber 28*a*, a second pump chamber 28*b*, a first power chamber 30*a*, and a second power chamber 30*b*. The housing 22 and the reciprocating assembly 24 also define, along with the pump's check valves 26, flow passages for the pumped fluid and for the working fluid during operation of the pump.

The members forming the illustrated pump's housing 22 include first and second manifold plates, 34*a* and 34*b*, first and second outer chamber plates, 36*a* and 36*b*, an intermediate member 38, a working fluid inlet member 40 (FIG. 2), and a working fluid outlet member 42. As is best seen in FIG. 1, the manifold plate members 34*a* and 34*b* and the outer members 36*a* and 36*b* coordinate to form passages in and out of the pump chambers 28*a* and 28*b*. To this end, these members include a series of coordinating manifold channels which are partially shown (but not specifically numbered) in the drawings. The check valves 26 dictate the correct flow direction of the pump fluid in a conventional manner.

Figure 2:
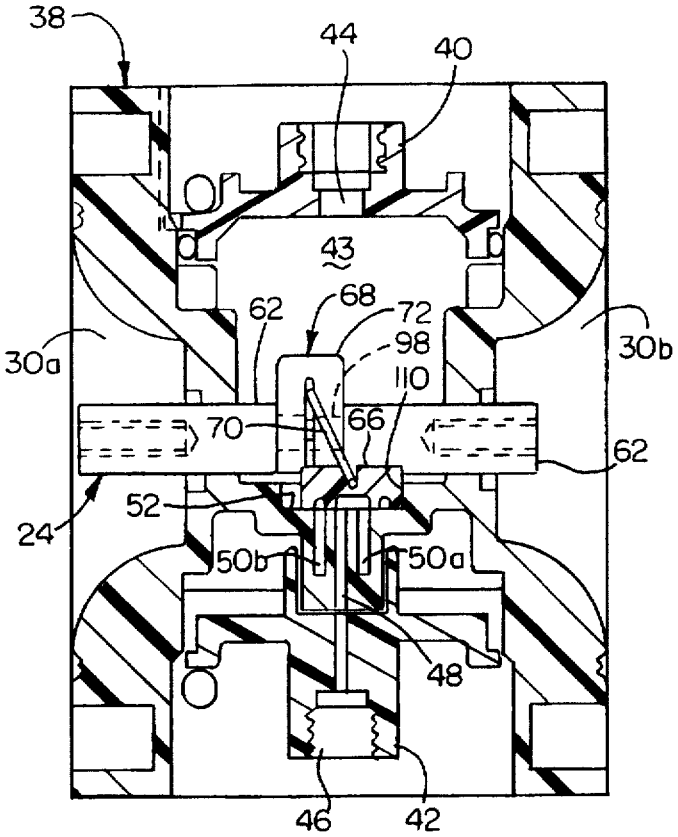
FIG. 2 is a partial cross-sectional plan view of the pump of FIG. 1 looking generally in the direction of arrows 2—2 of FIG. 1 and with its reciprocating assembly in the first position and with certain parts omitted for clarity.

As is best seen in FIG. 2, the intermediate member 38 and the inlet and outlet members 40 and 42 coordinate to form passages in and out of the power chambers 30*a* and 30*b* for the working fluid. To this end, the intermediate member 38 and the working fluid inlet member 40 together form a working fluid inlet cavity 43. The working fluid inlet member 40 includes an inlet passage 44 for introducing the working fluid into the cavity 43 and the working fluid outlet member 42 includes an outlet passage 46 for exhausting the fluid from the pump 20. The intermediate member 38 includes an outlet passage 48, which communicates with the outlet member's outlet passage 46, a first working fluid passage 50*a*, which communicates with the first pump chamber 30*a*, and a second working passage 50*b*, which communicates with the second pump chamber 30*b*. As is explained in more detail below, the reciprocating assembly 24 controls the flow of the working fluid through the two working fluid passages 50*a* and 50*b*, and through the outlet passage 48.

Figure 3:
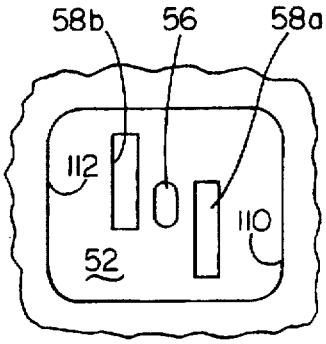
FIG. 3 is a top plan view of a portion of the pump's housing forming a valve surface.
Figure 4:
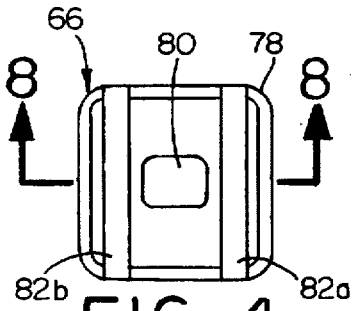
FIGS. 4, 5, 6, and 7 are top, side, bottom, and end views of a valve member which forms part of the reciprocating assembly.
Figure 5:
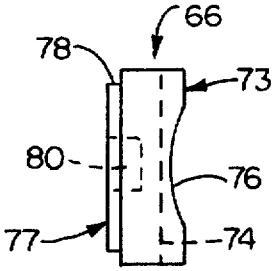
Figure 6:
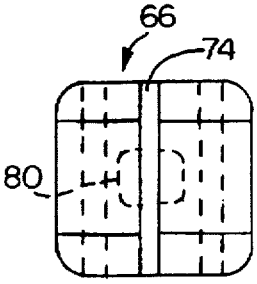
Figure 9:
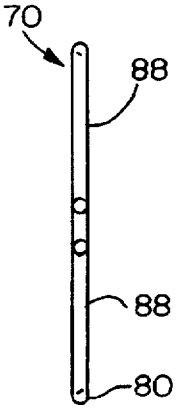
FIGS. 9 and 10 are top and end views of a spring forming a part of the control valve actuator.
Figure 10:
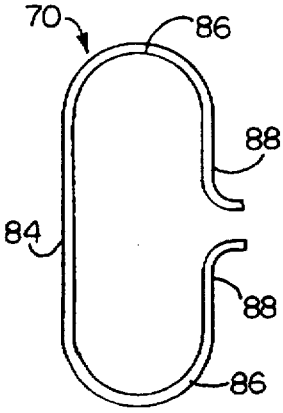
Figure 7:
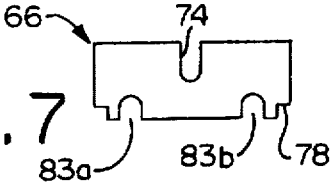
Figure 8:
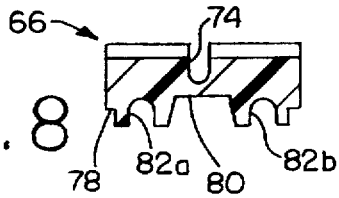
FIG. 8 is a sectional view of the valve member taken along line 8—8 in FIG. 4.
Figure 11:
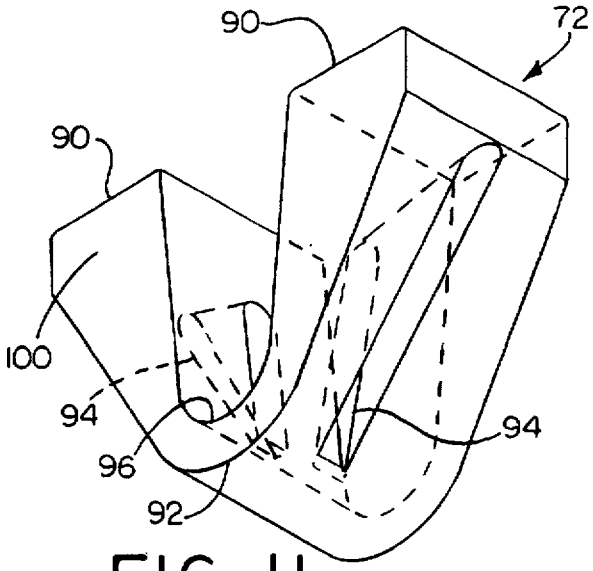
FIG. 11 is a perspective illustration of a spring carrier forming a part of the control valve actuator.
Figure 12:
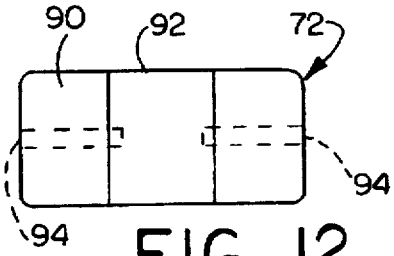
FIGS. 12, 13, 14, and 15 are top, bottom, side, and end views of a spring carrier of FIG. 11.
Figure 14:
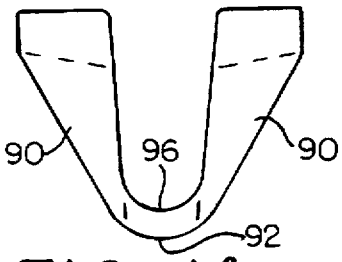
Figure 15:
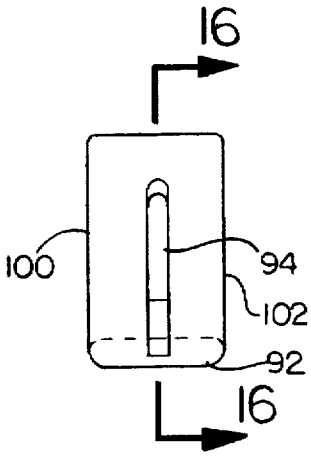
Figure 16:
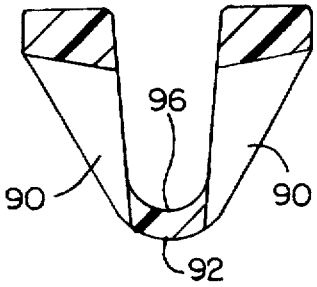
FIG. 16 is a sectional view of the spring carrier taken along line 16—16 in FIG. 15.
Figure 13:
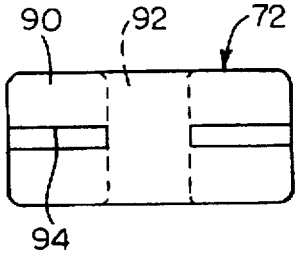

The intermediate member's passages 48, 50*a*, and 50*b* extend perpendicularly from a flat, approximately rectangular surface, which forms a valve surface 52 for the reciprocating assembly 24. (Thus, generally, the housing 22 forms the valve surface 52.) As is best seen in FIG. 3, the valve surface 52 includes an oval opening 56 forming the end of the outlet passage 48, and first and second rectangular openings 58*a* and 58*b* forming the ends of the pump chamber passages 50*a* and 50*b*. These openings are positioned and sized to coordinate with the reciprocating assembly 24 to introduce alternately and to exhaust the working fluid from the first and second pump chambers 30*a* and 30*b* as is described more fully below in connection with FIGS. 17A–D. Specifically, the opening 56 is centrally positioned relative to the valve surface 52. The first and second rectangular openings 58*a* and 58*b* are positioned on opposite transverse sides of the central outlet opening 56.

The reciprocating assembly 24 (FIG. 1) includes a first piston assembly 60*a*, a second piston assembly 60*b*, and a reciprocating rod member 62 connected between the two piston assemblies. As was indicated above, the preferred and illustrated pump 20 is an air actuated double diaphragm pump. Accordingly, the first and second piston assemblies 60*a* and 60*b* include first and second diaphragms 64*a* and 64*b*, and also inner and outer plates (shown but not specifically numbered) coupling the center of the diaphragms to opposite ends of the rod 62. The rod 62 extends slidably through appropriately sealed openings in the intermediate housing member 38, and its central portion is positioned within the pump fluid inlet cavity 43.

The circumferential edge of the first diaphragm 64*a* is captured between appropriately placed grooves in the first outer chamber plate 36*a* and the intermediate housing member 38. Likewise, the circumferential edge of the second diaphragm 64*a* is captured between appropriately placed grooves in the second chamber plate 36*b* and the intermediate housing member 38. (The grooves are shown in FIGS. 1 and 2, but not specifically numbered.)

The first piston member 60*a* separates the first pump chamber 28*a* from the first power chamber 30*a*. The second piston member 60*b* separates the second pump chamber 28*b* from the second power chamber 30*b*. During operation of the pump 20, the volumes of the first and second pump chambers 28*a* and 28*b* alternately increase and decrease with a corresponding decrease and increase in the volumes of the first and second power chambers 30*a* and 30*b* causing the rod 62 to reciprocate. Specifically, the rod 62 (and, therefore, the reciprocating assembly 24) moves between a first position, in which the first pump chamber 28*a* is at a maximum volume and the first power chamber 30*a* is at a minimum volume, and a second position in which the second pump chamber 28*b* is at a maximum volume and the second power chamber 30*b* is at a minimum volume. In FIG. 1, the pump 20 is shown with the reciprocating assembly 24 in the second position. In other words, as the reciprocating assembly moves from the position shown in FIG. 1 toward its opposite position, the pumped fluid is drawn into the first pump chamber 28a and is discharged from second pump chamber 28b, and the working fluid is exhausted from the first power chamber 30a and is introduced into the second power chamber 30b.

In addition to the rod 62 and the piston members 60 described above, the reciprocating assembly 24 (FIG. 2) includes a valve member 66 and a control valve actuator 68. The valve member 66 establishes the appropriate communication between the power chambers 30a and 30b and the working fluid inlet and outlet passages 40 and 42. The control valve actuator 68 switches the valve member 66 between opposite positions as described more fully below. In addition, a control valve actuator 68 maintains a fluid-tight seal between the valve surface 52 and the valve member 66.

To accomplish its switching and sealing functions, the control valve actuator 68 includes a spring 70 and a spring carrier 72. The valve member 66 is coupled to the spring 70, the spring 70 is coupled to the spring carrier 72, and the spring carrier 72 is coupled to the reciprocating rod member 62. Thus, the control valve actuator 68 is coupled only to the reciprocating rod 62 and the valve member 66 is free of any other connections.

FIGS. 4–9 show the valve member 66 in detail. The bottom face 73 of the valve member 66 is configured to cooperate with the valve surface 52 (FIGS. 2 and 3), while its top surface is shaped to receive the spring 70. The top face 73 of the valve member 66 includes a transversely extending groove 74 and a longitudinally extending curved indent 76. The groove 74 is sized and positioned to receive the spring 70 so as to couple the valve member 66 to the reciprocating rod member 62. The curved indent 76 is sized and positioned to accommodate the diameter of the reciprocating rod 62. Specifically, in order to make the pump 20 compact, the valve member 66 is as close to the rod 62 as possible. The arcuate relief 76 in the top face 73 of the valve member 66 allows the rod 62 and valve member 66 to slide without interfering with each other, as shown in FIG. 2. Referring now to FIGS. 9–16, the components of the control valve actuator 68 are shown in detail. As was indicated above, the control valve actuator 68 comprises the spring 70 and the spring carrier 72. The spring 70 (FIGS. 9 and 10) is generally shaped (in its neutral state) like an elongated ellipse and includes a straight portion 84, curved side portions 86, and outwardly turned end portions 88. The straight portion 84 fits with the groove 74 of the valve member 66, the side portions 86 extend between the valve member 66 and the spring carrier 72 (FIG. 11), and the spring's end portions 88 cooperate with the spring carrier 72 for coupling purposes.

The spring carrier 72 (FIGS. 11–16) comprises a roughly U-shaped component having legs 90 joined by a curved central portion 92. The legs 90 each include a slot 94 which is generally triangular in cross-sectional shape. The slots 94 extend through the respective side portion and open into the interior to of the U-shaped carrier 72. The slots 94 are sized and positioned to receive the ends 88 of the spring 70. The inner concavely curved surface 96 of the joining portion 92 forms a cradle 96 for the reciprocating rod member 62 and its outer surface has a circular contour to match the outer diameter of the rod 62. The rod member 62 includes a central reduced diameter portion 98 (FIGS. 1, and 2) shaped to accommodate the spring carrier 72.

The outside diameter of the reduced diameter portion 98 of the rod 62 is the same as the distance between the legs 90 of the carrier 72. Further, the length of the reduced diameter portion 98 is the same as the distance between the opposite end faces 100 and 102 (FIG. 15) of the carrier 72. As a result, the carrier 72 fits snugly around the reduced diameter portion 98 of the rod 62 and is forced to move together with the rod as it reciprocates.

The operation of the pump 20 and the interaction between the valve member 66 and the rod 62 through the actuator assembly 68 which causes the rod 62 to reciprocate is described as follows. The description of the operating sequence begins arbitrarily with FIG. 17A where the valve member is shown in its far right position and fluid under pressure is admitted through passage 50b to working fluid chamber 30b, and spring 70 in a top dead center position. As illustrated, the spring 70 is essentially perpendicular to the axis of rod 62. The spring is pushing the valve member against the surface 52. As fluid flows through the passage 50b, the diaphragm 64b pulls the rod 62 to the right. With slight additional movement of the rod 62 to the right from the position shown in FIG. 17A, the spring 70 causes the valve member 66 to shift to the left to the position shown in FIG. 17B. This occurs because, as shown in the FIG. 17A position, the spring 70 is in a position of equipoise, and a slight movement of the rod 62 in either direction moves it over center. When the rod 62 moves to the right, with the valve member 66 is then urged to the left. (The valve member stops moving to the left because of contact between a wall 112 which is formed at the left end of the valve surface 52.)

Figure 17A:
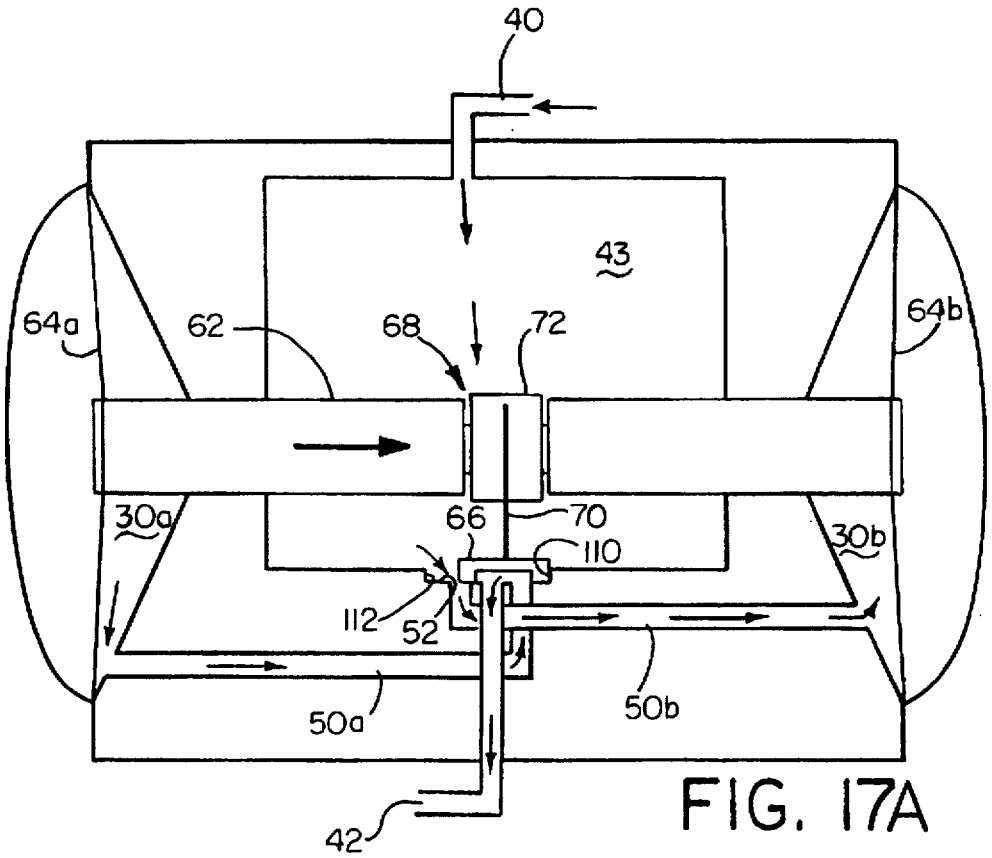
FIGS. 17A–D are schematic illustrations of a pump constructed in accordance with the present invention in sequential operating positions.
Figure 17B:
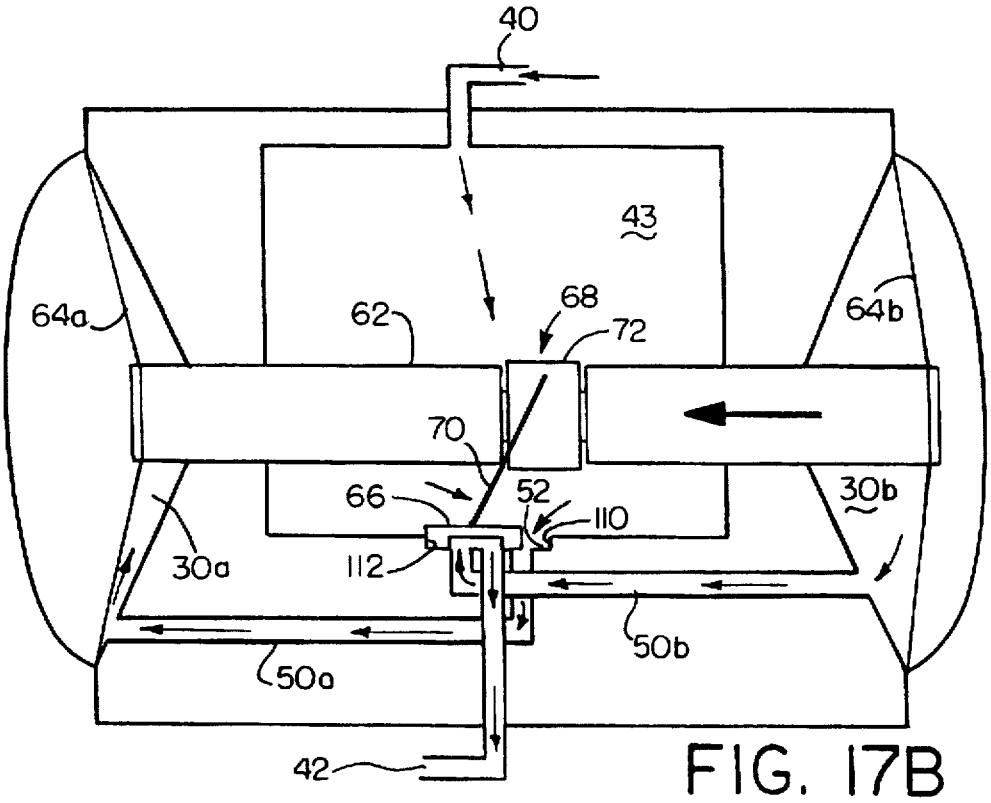
Figure 17C:
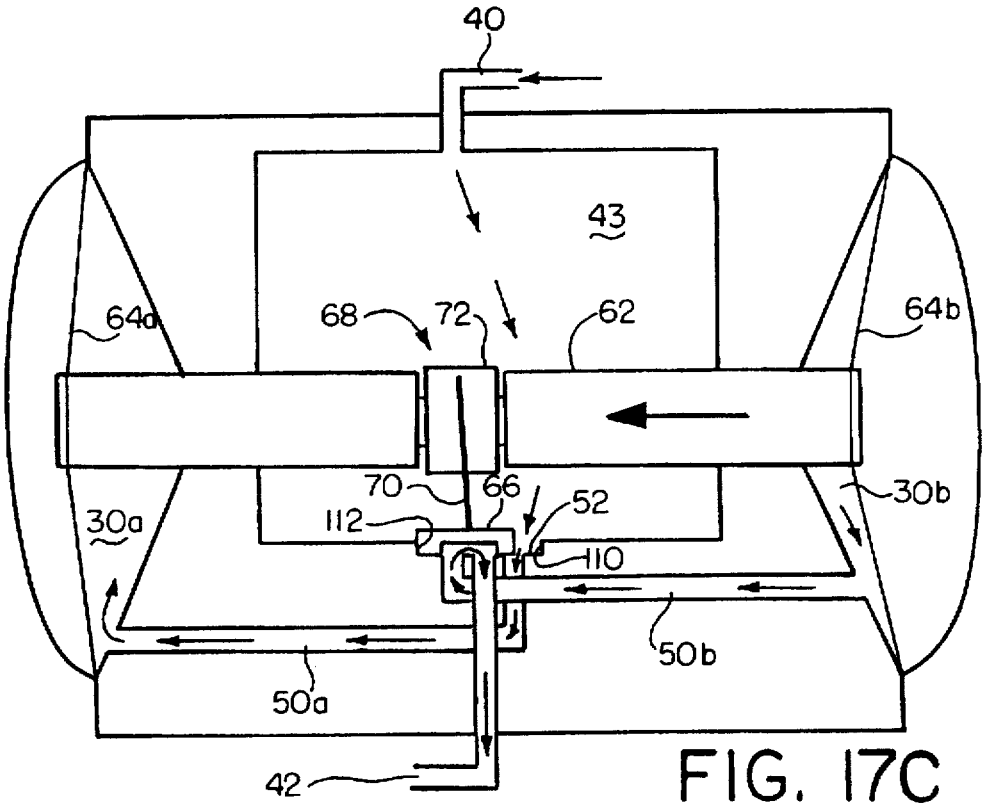

In the FIG. 17B position, the chamber 30b which had been under pressure is vented through passage 50b to the exhaust 42. At the same time the working fluid under pressure passes through chamber 43 and through passage 50a into chamber 30a. This action reverses the forces on the rod 62, moving it toward the left.

Figure 17D:
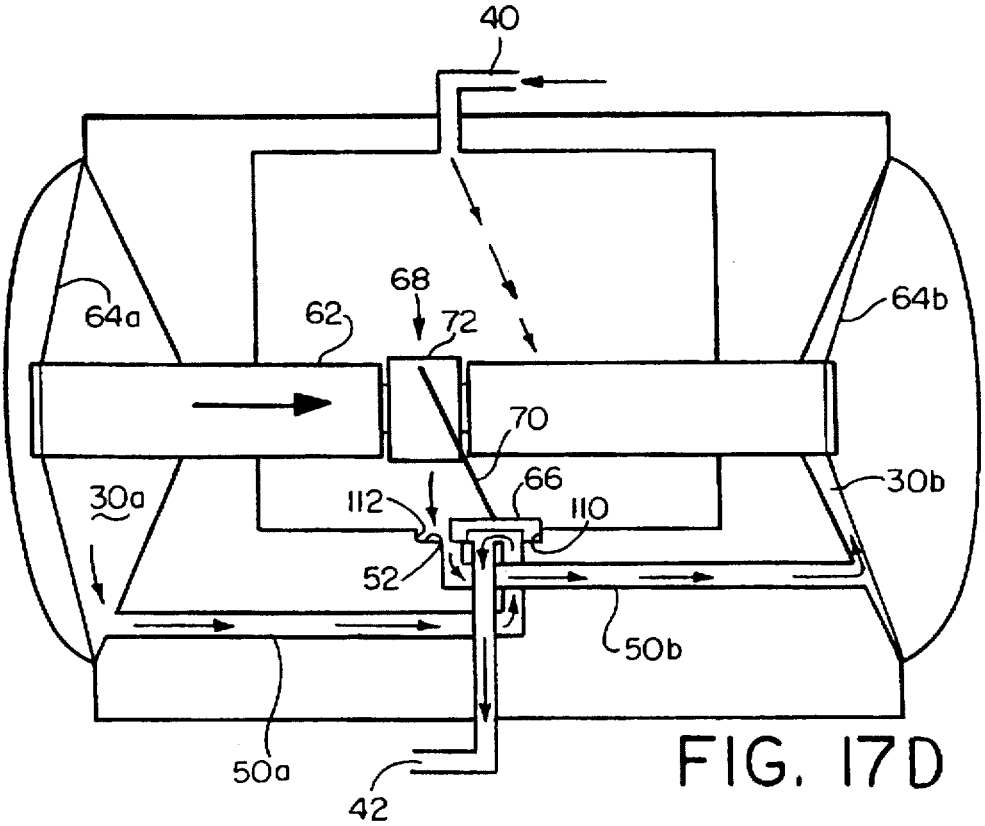

Eventually the pressure in chamber 30a moves the rod 62 to a position in which the spring 70 is again in a position of equipoise, being perpendicular to the axis of the rod 62. A slight further movement of the rod 62 to the left brings it to the position shown in FIG. 17C. At this point the valve member 66 is suddenly subject to a lateral force from the spring 70 which snaps the valve member to the right, to the position shown in FIG. 17D. Again a wall 110 on the right side of the valve surface 52 limits the motion of the valve member and positions it so that, as shown in FIG. 17D, fluid under pressure from the chamber 43 is fed through passage 50b and into chamber 30b. At the same time fluid from chamber 30a is directed to the exhaust 42. This moves the rod 62 from the position shown in FIG. 17D to the position shown in FIG. 17A, and the cycle can begin again.

It is apparent that as the rod member 62 approaches either of the two points of equipoise, the spring 70 will become more and more compressed. Just as the rod member 62 passes the midpoint, the X component of the spring's compression force vector will switch the valve member 66 to the opposite position. The Y component of the spring's compression force vector constantly points towards the valve surface 52 thereby urging the valve member 66 towards the valve surface 52 to form a fluid-tight seal therebetween. Thus, the spring 70 has a force vector with one non-zero directional component parallel with a line between the first and second positions of the valve member 66 and another non-zero directional component perpendicular to the other directional component and passing through the valve member 66. Spring 70 remains in a compressed state (i.e., not a neutral state) as it moves from the first position to the second position, although the magnitude of the compression force varies.

The various connections between the control valve actuator 68 and the valve member 66 as well as the connections between the control valve actuator and the reciprocating rod member 62 have been described as being essential free of any excessive play. However, it is also contemplated that any of the connections could include a lost motion component if desired. For example, the reduced diameter portion 98 could be longer than the distance between the opposite end faces 100 and 102 of the carrier 72. Obviously, the lost motion could be built into any of the connections between the reciprocating rod member 62 and the valve member. Thus the term coupled includes both directly coupled as shown in the Figures and indirectly coupled by means of a lost motion connection.

One may now appreciate the present invention provides a simplified pump design in which the control valve actuator 68 performs both switching and sealing functions. Although the invention has been shown and described with respect to a preferred embodiment, it is obvious that equivalent alternations and modifications will occur to others skilled in the art upon the reading and understanding of this specification. The present invention includes all such equivalent alterations and modifications and is limited only by the scope of the following claims.

What is claimed is:

1. A fluid driven reciprocating pump comprising a housing and a reciprocating assembly, wherein:

the housing and the reciprocating assembly define first and second working fluid chambers;

the housing defines a working fluid inlet passage through which a working fluid is introduced under pressure, a working fluid outlet passage through which the working fluid is exhausted, and a valve surface which interacts with the reciprocating assembly;

the reciprocating assembly includes a valve member, a control valve actuator, and a reciprocating rod;

the valve member slidably moves against the valve surface between a first position, wherein the first working fluid chamber communicates with the working fluid inlet passage and the second working fluid chamber communicates with the working fluid exhaust passage, and a second position, wherein the first working fluid chamber communicates with the working fluid outlet passage and the second working fluid chamber communicates with the working fluid inlet passage;

the reciprocating rod member moves in response to the alternate introduction and exhaustion of the working fluid into and out of the first and second working fluid chambers, respectively; and the control valve actuator switches the valve member between the first and second positions in response to the movement of the reciprocating rod member and also urges the valve member toward the valve surface to form a fluid-tight seal as the valve member moves between the first and second position between the valve member and the valve surface.

2. A pump as set forth in claim 1 wherein the control valve actuator is coupled to the reciprocating rod member and the valve member.

3. A pump as set forth in claim 2 wherein the control valve actuator is coupled only to the reciprocating rod member and the valve member.

4. A pump as set forth in claim 2 wherein the control valve actuator is coupled to the reciprocating rod member and the valve and is free of any other connections.

5. A pump as set forth in claim 1 wherein the valve surface includes an opening which communicates with the working fluid outlet passage.

6. A pump as set forth in claim 1 wherein the reciprocating assembly further comprises first and second piston members each including flexible diaphragms.

7. A pump as set forth in claim 6 wherein the control valve actuator includes a biasing element.

8. A pump as set forth in claim 7 wherein the rod member moves between first and second positions opposite from the valve member's first and second positions and wherein the biasing element is a spring which reaches a maximum compression when the rod member is between its first and second positions.

9. A pump as set forth in claim 8 wherein the spring has a force vector with one non-zero directional component parallel with a line between the first and second positions of the valve member and another non-zero directional component perpendicular to the other directional component and passing through the valve member.

10. A pump as set forth in claim 9 wherein the spring is in compression as the valve member moves between the first direction and the second direction.

11. A double diaphragm pump having a rod connecting opposed diaphragms, an inlet for fluid under pressure to operate the pump and an outlet for exhausting the fluid under pressure from the pump, a valve assembly controlling the flow of fluid under pressure to direct it alternately against one diaphragm and then the other diaphragm, the valve assembly including a valve surface having a pair of openings for a pair of passages leading to a pair of chambers each closed by one of the diaphragms, and an opening leading to an exhaust port, a valve member slidable across the valve surface between a first position in which fluid under pressure is directed through one of the passages to one of the chambers while fluid from the other chamber is directed through the other passage to the exhaust port, and a second position in which fluid under pressure is directed through the other of the passages to the other of the chambers while fluid from the one chamber is directed through the one passage to the exhaust port, and a spring connected to the rod and to the valve member and positioned to bias the valve member against the valve surface and to cause the valve member to move between the two positions in response to movement of the rod.

* * * * *